US005679072A

United States Patent [19]

Brodin et al.

[11] Patent Number: 5,679,072

[45] Date of Patent: Oct. 21, 1997

[54] EMERGENCY VEHICLE EXHAUST SYSTEM

[75] Inventors: Erik S. Brodin, Circle Pines; Michael W. Holmquist, Burnsville, both of Minn.

[73] Assignee: Ventaire, Inc., Burnsville, Minn.

[21] Appl. No.: 587,269

[22] Filed: Jan. 17, 1996

[51] Int. Cl.[6] ..... F23J 11/02

[52] U.S. Cl. ..... 454/63; 285/9.1; 285/62

[58] Field of Search ..... 454/63, 64; 285/1, 285/9.1, 62; 60/315

[56] References Cited

U.S. PATENT DOCUMENTS

| | | | |
|---|---|---|---|
| 5,096,230 | 3/1992 | Pausch et al. | 454/63 X |
| 5,162,017 | 11/1992 | Nordin | 454/63 |
| 5,453,048 | 9/1995 | Zima et al. | 454/63 |

FOREIGN PATENT DOCUMENTS

| | | | |
|---|---|---|---|
| 96048 | 9/1982 | U.S.S.R. | 285/9.1 |

*Primary Examiner*—Harold Joyce

*Attorney, Agent, or Firm*—Clayton R. Johnson

[57] ABSTRACT

An emergency exhaust system is couplable to a vehicle for conducting exhaust fumes from the vehicle exhaust pipe to an enclosure ventilation system to be exhausted from the vehicle enclosure when the vehicle is normally parked when not being used. The exhaust system includes an elongated flexible hose assembly that is connected to the ventilation system and to an adaptor conduit which at its terminal end has a ring mounting electromagnets for magnetically attaching to a mount plate dependingly secured to the vehicle to have the vehicle exhaust pipe extend therethrough. An intermediate portion of the hose assembly is connected through a balancer assembly to a trolley movable along a rail in a forward direction as the vehicle moves to exit the enclosure. As the trolley moves adjacent to the rail front end, through automatic controls, the magnetic coupling to the mount plate is disengaged. As a result of not coupling directly to the exhaust pipe, the chances of damaging the vehicle exhaust system are minimized, but provision is made for safely conducting the vehicle exhaust fumes outside of the enclosure.

6 Claims, 2 Drawing Sheets

EMERGENCY VEHICLE EXHAUST SYSTEM

BACKGROUND OF THE INVENTION

A system for safely removing exhaust fumes from a vehicle, particularly from emergency vehicles parked in a vehicle bay in an enclosure.

It is old to mechanically clamp one end of a flexible hose to a vehicle exhaust pipe of a motor vehicle having an internal combustion engine, or to slip the one end of a hose over the exhaust pipe with the hose opening to the outdoor ambient atmosphere, or to an exhaust duct system that opens to the outdoors, to exhaust fumes from a vehicle which is parked inside of an enclosure. Also, in the prior art, it is old to provide a pneumatic grabber type nozzle (pneumatic grabber) that physically grabs and holds on to a vehicle exhaust pipe. Such pneumatic grabbers may cause damage to the vehicle exhaust system if the grabber fails to deflate upon vehicle exit.

In order to minimize problems that are at times encountered with prior art mechanism, as well as to overcome other problems, this invention has been made.

SUMMARY OF THE INVENTION

The motor vehicle exhaust system includes a flexible hose having upper and lower hose sections connected by a lifting elbow for fluidly connecting the vehicle enclosure exhaust system to an adaptor that is electromagnetically attachable to a mount plate which is dependingly joined to the vehicle underside to have the exhaust pipe extend therethrough whereby exhaust fumes are drawn into the adaptor conduit. The lifting elbow is mounted by a cable of a spring balancer assembly which in turn is mounted to a trolley that is movable along a longitudinally elongated rail in a forward direction as the vehicle with the adaptor coupled to the mount plate exits from the enclosure. When the vehicle has moved sufficiently forwardly that the exhaust pipe is closely adjacent to the enclosure doorway, the trolley is moved into the sensing range of a sensor which automatically deenergizes the magnets whereby the adaptor is decoupled from the mounting plate prior to the vehicle completely exiting through the doorway and possibly damaging the hose sections and adaptor.

One of the objects of this invention is to provide a new and novel exhaust system for conducting exhaust fumes from a vehicle exhaust to an enclosure ventilation exhaust system. In furtherance of the last mentioned object, it is another object to provide new and novel means for releasably coupling to a vehicle to conduct exhaust fumes from the vehicle exhaust to exhaust the fumes from a vehicle enclosure. A further object of this invention is to provide new and novel means for coupling to a motor vehicle to conduct exhaust fumes away from the vehicle in a safe manner and minimize the chances of accidently damaging the vehicle exhaust system. A different object of this invention is to provide new and novel means for connecting a flexible exhaust fume hose to a vehicle to conduct fumes from the vehicle exhaust pipe to an enclosure ventilation exhaust system or device to exhaust the fumes external of the enclosure without directly connecting the hose to the vehicle exhaust system.

DESCRIPTION OF THE PREFERRED EMBODIMENT

Figure 1:
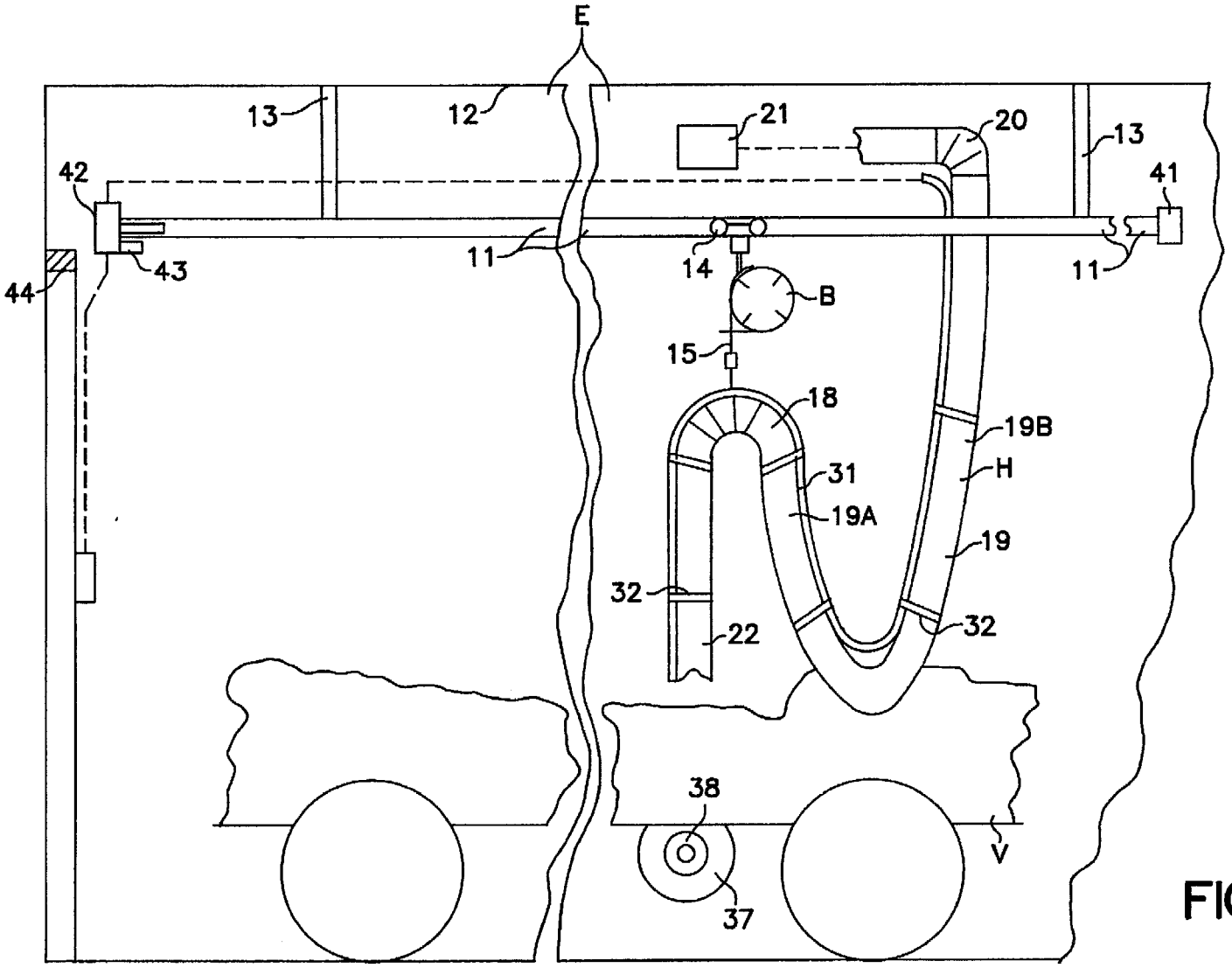
FIG. 1 is a fragmentary, somewhat diagrammatic view of the emergency vehicle exhaust system of this invention in an enclosure with longitudinal intermediate parts broken away and only parts of an emergency vehicle being diagrammatically shown in a side view.
Figure 4:
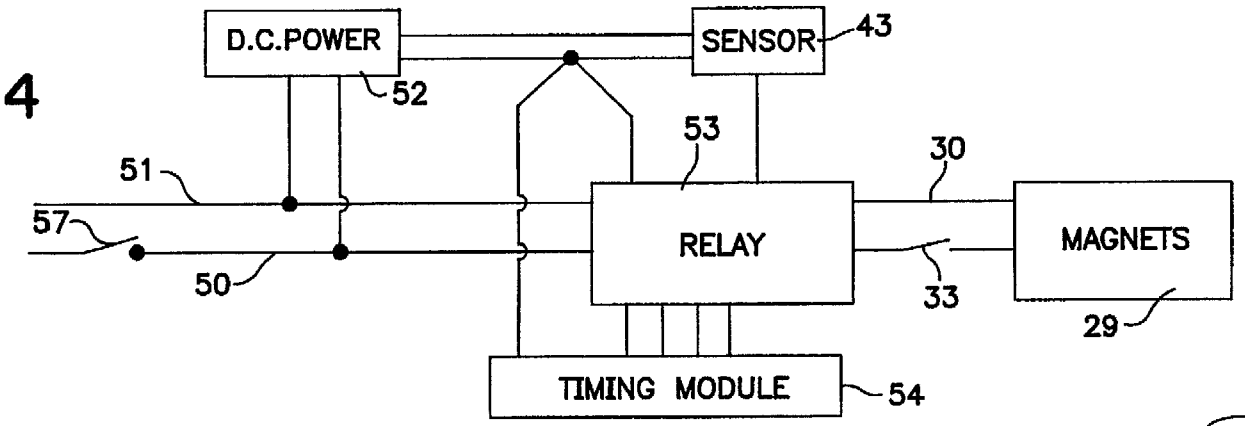
FIG. 4 is a simplified schematic showing of the electric controls of the exhaust system of this invention.
Figure 5:
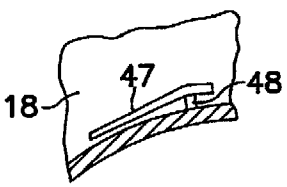
FIG. 5 is a fragmentary, somewhat diagrammatic view showing the safety cable attached to the lifting elbow.
Figure 3:
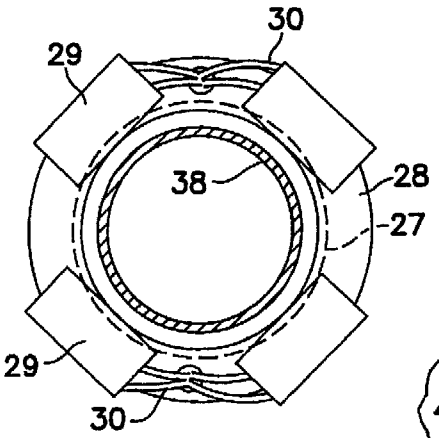
FIG. 3 is an end view of the adaptor angle iron with the electromagnets in angular spaced relationship and radial spaced relationship to a motor vehicle exhaust pipe which is shown in cross section.
Figure 6:
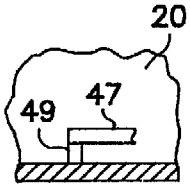
FIG. 6 is a fragmentary, somewhat diagrammatic view showing the safety cable attached to the rigid duct of the enclosure ventilation system.
Figure 2:
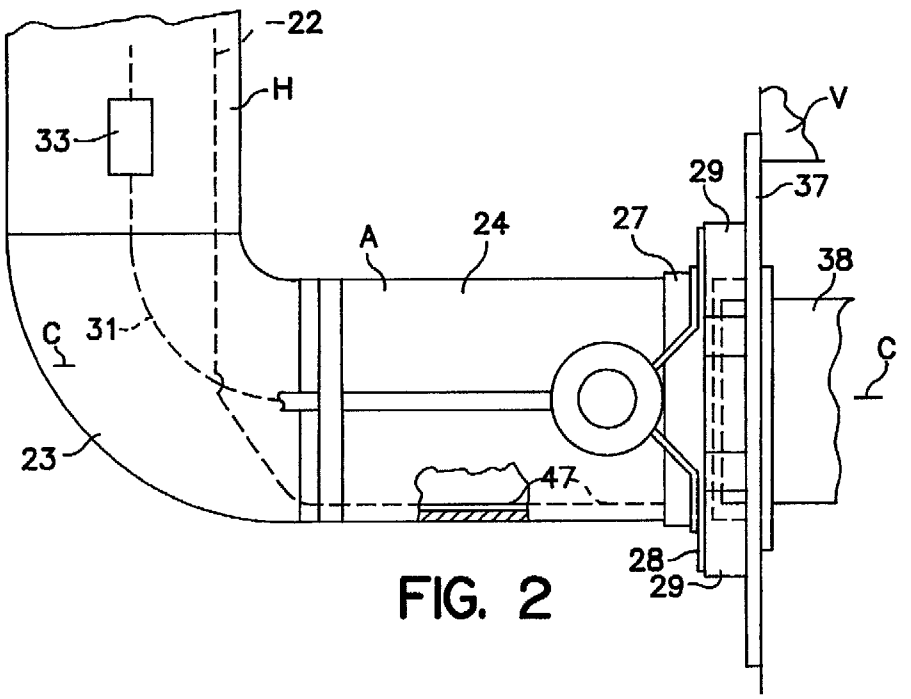
FIG. 2 is an enlarged fragmentary transverse view of the inlet end portion of the lower hose section, the electromagnetic adaptor and the mount plate end portion with the hose assembly in an attached relationship to the mount plate to exhaust fumes emitting from the exhaust pipe of an emergency vehicle to an enclosure ventilation exhaust system.

Referring to the drawings, the exhaust system of this invention, generally designated 10, is adapted to be mounted in an enclosure E, for example a bus garage, auto repair shop, fire stations and other emergency vehicle stations or buildings. A longitudinally elongated, generally horizontal rail 11 is mounted to the ceiling 12 (or wall) of the enclosure by suitable brackets 13, the rail mounting a trolley 14 for longitudinal movement along the rail. A conventional spring balancer assembly B is dependingly mounted to the trolley for movement therewith. The balancer assembly includes a balancer cable 15 that is resiliently retained in a retracted position such as shown in FIG. 1 with the spring tension urging the cable to its retracted position in a conventional manner.

A terminal end portion of the balancer assembly cable is attached to the lifting elbow 18 of a flexible hose assembly H. One end portion of a flexible upper hose section 19 of the hose assembly H is connected to the lifting elbow while the other end portion is connected through a rigid duct 20 of the building ventilation exhaust system 21 for drawing fluid from the enclosure and exhausting it to the outside ambient atmosphere. The ventilation system includes an exhaust fan (not shown) or alternately the rigid elbow is fluidly connected directly to the exhaust fan to directly exhaust fumes exterior of the enclosure.

The lifting elbow fluidly connects the inlet end of the upper hose section to one end of the flexible lower hose section 22 while the lower (inlet) end of the lower hose section is fluidly connected through an elbow 23 of an electromagnetic adaptor A to the outlet end of a rigid conduit 24. The opposite end (inlet end) of the conduit mounts an electromagnetic adaptor angle ring 27. Mounted to the surface of the annular flange 28 of the angle ring transversely opposite the conduit outlet end are a plurality of electromagnets 29 in substantially equal angularly spaced relationship to one another without blocking any significant part of the opening through the ring. Electric leads 30 are connected to the magnets and extended through an electric conduit 31 which extends along the hose assembly H and is attached thereto by mounting straps 32. Mounted to the lower hose section 22 adjacent to the lower elbow 23 is a manual on-off switch 33 for selectively controlling the application of power to the electromagnets.

To facilitate the magnetic attachment of the electromagnetic adaptor to the internal combustion engine vehicle V, an apertured mount plate 37 is permanently dependingly attached to the vehicle chassis underside at one side of the vehicle to have the terminal end portion of the vehicle exhaust pipe 38 extend transversely through the mount plate aperture and transversely outwardly of the mount plate; or if the exhaust pipe does not extend sufficiently transversely outwardly of the vehicle chassis to one side of the vehicle for easily having the electromagnets properly engaging the mount plate, an appropriately shaped exhaust pipe extension (not shown) is permanently attached to the vehicle exhaust pipe.

With the magnets magnetically attached (coupled) to the mount plate 37, advantageously the terminal end portion of the exhaust pipe terminates transversely intermediate the mount plate and the angle ring or a very short distance into the conduit 24. Advantageously, the mount plate aperture is about the same diameter as the inner diameter of adaptor conduit 24 and is of a larger diameter than the outer diameter of the exhaust pipe terminal end portion to provide an annular clearance space. When the adaptor is coupled to the mount plate, the conduit may in part extend beneath the vehicle, or entirely outwardly of the vehicle, dependingly upon the location of the terminal end of the exhaust relative to the vehicle chassis, with the conduit extending transversely outwardly of the vehicle. As an example, but not otherwise as a limitation, the inner diameter of conduit 24 may be about 6 inches and at least about an inch greater than the outer diameter of the exhaust pipe terminal end portion. The suction power of the ventilating system together with the annular clearance between the mount plate and the conduit 24 is sufficiently great that the gases exhausted through the exhaust pipe do not leak into the enclosure, in part due to air within the ambient atmosphere in the enclosure being drawn through the above mentioned annular clearance and into the conduit 24. Thus, the exhaust fumes emitting from the exhaust pipe do not mix with the ambient atmosphere in the enclosure that is outside of the exhaust system 10 that surrounds the vehicle and exhaust system. Advantageously, the volume of air drawn through the annular clearance space is many times greater than the volume exhaust gases being emitted from the exhaust pipe.

To limit the movement of the trolley in a rearward direction and cushion the stopping of the rearward movement, a rear resilient stop 41 is mounted to the rear end of the rail while to limit the movement in a forward direction, a front resilient stop 42 is mounted to the front end of the rail. A photoelectric eye (sensor) 43 is mounted to the front end stop 42 for sensing the movement of the trolley adjacent thereto and connected in a circuit for discontinuing the application of electric power to the electromagnets prior to the trolley abutting against the front end stop.

Suitable electrical controls are provided, for example, A.C. input lines 50, 51 are connected to energized each of a D.C. rectifier 52 and a relay 53. The rectifier is connected to provide a D.C. voltage to a photoelectric eye unit (sensor) 43 which controls the relay 53 to in turn control the energization of the (application of D.C. power to) electromagnetics when the manual switch 33 is closed. The trolley, in moving within the sensing range of the sensor (breaking the beam of the photoelectric eye unit) 43, provides a signal to the conventional relay 53 to discontinue the application of D.C. power from rectifier to the magnets. A timing module 54 is connected in a circuit to the relay 53 and the D.C. rectifier to permit adjusting the time the electromagnets are maintained in a deenergized condition once the trolley comes within the sensing range and remains in the sensing range, and then automatically reestablishes a circuit (not shown) from the rectifier and through the relay to reenergize the electromagnets even if the trolley remains within the sensing range. The module, relay and sensor are of conventional types so that, upon the trolley coming within the sensing range of the sensor, the power to the electromagnets is automatically discontinued and remains discontinued for a preset period of time and then is automatically reapplied to reenergize the electromagnets; or if the trolley moves out of the sensing range prior to the end of the preset time, automatically reenergizes the electromagnets upon the trolley moving out of the sensing range. Advantageously, a master on-off switch 57 is provided in the A.C. input lines 50, 51. Alternately, A.C. lines may be connected to a D.C. rectifier that furnishes D.C. power to the sensor which controls the application of D.C. power to leads 30, including through switch 33 in a closed position. It is believed that it is not necessary to set forth further details of the control circuitry to function as described herein since, in view of the description contained herein, it would be very easy for one skilled in control circuitry to provide suitable electric controls.

The spring characteristics of the balancer assembly B are, or are adjustable, so as to retain the adaptor A angle ring at about the same elevation as the terminal end portion of the vehicle exhaust pipe when the balance cable is in its retracted position of FIG. 1 and the lower hose section extends substantially vertically. At this time, the upper hose section extends downwardly from the lifting elbow along hose leg 19A and thence reversesly curved to extend upwardly along hose leg 19B to the ventilation system duct 20. In a datum position, the balancer assembly cable is fully retracted and with the upper hose section extending to its lowermost relaxed, position, the adaptor is located longitudinally adjacent to and at about the same elevation as the exhaust pipe of the vehicle when the vehicle has been backed into the enclosure and is in its normal parked position in the enclosure.

When the vehicle is entirely in the enclosure E with its front end adjacent to the enclosure doorway 44 and electric power is applied to the electromagnets, the magnetic adaptor A is manually moved to a longitudinal position that the magnets are transversely adjacent to the mount plate 37, if not already in such a position, and then the adaptor A is transversely moved whereby the magnets magnetically engage the mount plate with the central axes C—C of the terminal end portion of the vehicle exhaust pipe and the adaptor conduit extends substantially coextensively. It is noted that with the manual switch 33 on the adaptor A, the electric power to the electromagnets can be discontinued at any time to facilitate positioning the adaptor A relative to the mount plate, or for other purposes, and reestablish the application of power to the electromagnets.

If the exhaust system 10 of this invention is being used in emergency vehicle facilities, advantageously the on-off control (not shown) of the exhaust ventilation system 21 is wired into the alarm system (not shown) to start the exhaustion of fluid through the system 21 and to continue to run for a preselected time after the initial sounding of the alarm and then automatically turn off.

With the adaptor magnetically attached to the mount plate, prior to starting the vehicle engine (not shown), the ventilation exhaust system is actuated which results in air in the enclosure being drawn through the annular clearance between the mounting plate and the exhaust pipe and between the magnets and the mount plate to flow into the adaptor conduit. With the vehicle engine (not shown) being started, the exhaust fumes together with ambient air in the enclosure are drawn into the adaptor conduit and continue to be drawn into the conduit as the vehicle moves forwardly to exit through the enclosure doorway 44. Assuming the hose assembly is in its datum position such as shown in FIG. 1, as the conduit moves forwardly with the vehicle, the trolley is moved forwardly along the rail 11 toward the sensor 43 and the angle of extension of the hose lower section relative to the enclosure floor progressively decreases in a rearward direction together with the upper section hose legs 19A, 19B diverging upwardly at progressively increasing angles or becoming arcuately curved about increasing radii of curvature together with possible unwinding of the balancer assembly cable. When the trolley moves into the sensing range of the sensor (breaks the beam of the photoelectric eye unit 43), an electric signal is sent to the relay 53 to operate the relay to deenergize the electromagnets whereby the magnetic coupling attachment between the magnets and the mount plate is broken and the exhaust pipe moves forwardly of the adaptor. At the time the trolley moves into the sensing range of the sensor, advantageously the vehicle front end portion has exited through the doorway and the adaptor is still within the enclosure, but is closely adjacent to the doorway.

Upon the coupling attachment between the adaptor and the mount plate being broken, the weight of the hose upper section results in the trolley moving rearwardly, and the lower hose section returns to extend generally vertically. If the trolley does not move sufficiently rearwardly to be out of the sensing range of the sensor as a result of the weight of the hose and the retracting of the balancer assembly cable, if extended as the vehicle moved forwardly, after the preset time delay of the timing module, the electromagnets are automatically reenergized.

A plastic coated aircraft safety cable 47 is provided within the hose assembly and at one end is fastened to one end of the angle ring, at an intermediate portion is fastened at 48 to the lifting elbow and at the opposite end is fastened at 49 to the rigid duct 20. The safety cable is provided to pull the adaptor off of the mounting plate in the event the power to the electromagnets is not cut off when the trolley moves forwardly into the sensing range of the sensor as the vehicle exits the enclosure.

Even though the lifting elbow in the hose datum position is shown as being forwardly of the hose leg 19B, it is to be understood that if the rigid duct inlet was located forwardly of that shown in FIG. 1, the lifting elbow may be located rearwardly of the hose leg 19B. If located rearwardly, as the vehicle moves forwardly, the upper part of leg 19A is first moved more longitudinally adjacent to the upper part of leg 19B and thence forwardly of hose leg 19B as the adaptor and trolley moves forwardly.

As an example of the invention, but not otherwise as a limitation thereon, each of the hose sections may be 6 inches in diameter, the lower section 10 feet in length and the upper section 20 feet in length which is the same as the length the rail. However, the rail may be of greater lengths, particularly if the vehicle is longer or the vehicle is parked further rearwardly of the doorway for the vehicle partially depicted in FIG. 1, then, advantageously, the upper hose section would be of a greater length than the depiction of the rail shown in FIG. 1. Further, the flexible hose sections may be constructed of two plies of black neoprene impregnated fiberglass fabric with circular steel wire helix embedded between the layers for support and strength. Desirably, the hoses are rated to 350° F. or higher.

What is claimed is:

1. Vehicle exhaust apparatus for conducting exhaust fumes from the terminal end portion of an exhaust pipe of a vehicle in an enclosure to an enclosure ventilation exhaust system, comprising a longitudinal rail mountable to the enclosure, said rail having a front end portion and a rear end portion, a trolley mounted to the rail for longitudinal movement along the rail, a spring balancer assembly dependingly mounted to the trolley for movement therewith, a mount plate adapted for attachment to a vehicle and having the exhaust pipe terminal end portion extended through an aperture in the mount plate, an elongated flexible hose assembly having a first end portion adapted for connection to the ventilation system and a second end portion, and an electromagnetic coupling adaptor for magnetically coupling engaging the mount plate to conduct exhaust fumes from the exhaust pipe terminal end portion to the hose, said hose assembly including a flexible upper hose section adapted for connection to the ventilation exhaust system, a flexible lower section connected to the conduit and a lifting elbow connecting the upper section to the lower section, the balancer assembly including a resilient retractable cable connected to the lifting elbow, said coupling adaptor including a fluid conduit having a first end fluidly connected to the hose second end portion and a second end portion, a plurality of electromagnets, and mounting means for mounting the electromagnets in angular spaced relationship to the conduit second end portion for couplingly to the mounting plate when the electromagnets are energized, said mounting means having the conduit opening therethrough, and control means for selectively energizing the electromagnets, said control means including photoelectric sensor means mounted adjacent to the rail front end portion for sensing the movement of the trolley adjacent to the rail front end portion and, upon the movement of the trolley toward the rail front end portion to a position adjacent to the rail front end portion, provide a signal and responsive means acting in response to said signal, automatically deenergizing the electromagnets.

2. The vehicle exhaust apparatus of claim 1 wherein the conduit is of an inner diameter that is substantially larger than the outer diameter of the exhaust pipe terminal end portion.

3. The vehicle exhaust apparatus of claim 1 wherein the mount plate aperture is of a diameter substantially greater than the outer diameter of the exhaust pipe terminal end portion to provide an annular clearance space therebetween.

4. The vehicle exhaust apparatus of claim 1 wherein the response means includes electrically operated means to maintain the electromagnets in a deenergized condition for an adjustable period of time after the photoelectric means provides said signal and then automatically reenergizes the electromagnets.

5. For conducting the exhaust fumes to the enclosure ventilation exhaust system from the terminal end portion of an exhaust pipe of a vehicle parked in an enclosure having a doorway, a mount plate having an aperture of a greater diameter than the exhaust pipe terminal end portion, said mount plate being joined to the vehicle to have the exhaust pipe terminal end portion extend through the plate aperture and provide an annular clearance space between the mount plate and the exhaust pipe terminal end portion, a longitudinally elongated rail having a front end portion and a rear end portion, said rail being mounted to the enclosure with the rail front end adjacent to the doorway, a trolley mounted to the rail for longitudinal movement along the rail, a spring balancer assembly dependingly mounted to the trolley for movement therewith, said balancer assembly having a retractable cable resiliently retained in a retracted condition, a lifting elbow mounted by the cable, a flexible upper hose section extending between the lifting elbow and the ventilation system, an electromagnetic adaptor releasably magnetically couplable to the mount plate, said adaptor including a plurality of electromagnets magnetically couplable to the mount plate, annular means for mounting the electromagnets in angular spaced relationship and a fluid conduit having an inlet end adjacent to the exhaust pipe terminal end and an outlet end, a flexible lower hose section for fluidly connecting the conduit outlet to the lifting elbow, said annular means being mounted to the conduit inlet end to position the electromagnets to magnetically couple the conduit to the mount plate for conducting fluid exhausting from the exhaust pipe terminal end portion, and also the fluid passing through the annular clearance space between the exhaust pipe terminal end portion and the mount plate, to the lower hose section, the upper hose section, with the trolley adjacent to the rail rear end, having a first leg that extends downwardly from the ventilation system and a lower end, a second leg that extends downwardly from the lifting elbow and has a lower end and a reversely curved portion joining the lower ends of the legs to one another, and control means for energizing the electromagnets and deenergizing the electromagnets when the trolley is moved adjacent to the rail front end portion, the control means including a photoelectric sensor mounted adjacent to the rail front end portion for sensing the movement of the trolley within a preselected distance of the rail front end portion to send a signal and electrical means acting in response to the signal for deenergizing the electromagnets.

6. The apparatus of claim 5 wherein the control means includes a manually operated on-off switch mounted to one of the conduit and the lower hose section for selectively permitting energization of the electromagnets and blocking the energization of the electromagnets.

* * * * *